United States Patent [19]

Dulmage et al.

[11] Patent Number: 4,743,939

[45] Date of Patent: May 10, 1988

[54] INTERMEDIATE TRANSFER APPARATUS

[75] Inventors: Jessica B. Dulmage, Fairport; Henry R. Till, Rochester, both of N.Y.

[73] Assignee: Xerox Corporation, Stamford, Conn.

[21] Appl. No.: 56,164

[22] Filed: Jun. 1, 1987

[51] Int. Cl.[4] ..... G03G 13/14; G03G 13/10; G03G 15/14; G03G 15/10

[52] U.S. Cl. ..... 355/3 TR; 355/10

[58] Field of Search ..... 355/3 TR, 14 TR, 10, 355/4; 430/33, 48, 126

[56] References Cited

U.S. PATENT DOCUMENTS

| | | | |
|---|---|---|---|
| 4,610,939 | 9/1986 | Mampaey et al. | 430/33 |
| 4,684,238 | 8/1987 | Till et al. | 355/3 TR |
| 4,690,539 | 9/1987 | Radulski et al. | 355/3 TR |

*Primary Examiner*—R. L. Moses

*Attorney, Agent, or Firm*—H. Fleischer; J. E. Beck; R. Zibelli

[57] ABSTRACT

An apparatus in which a liquid image is transferred from a photoconductive member to a copy sheet. The liquid image, which includes a liquid carrier having toner particles dispersed therein, is attracted from the photoconductive member to an intermediate belt having a transfer liquid coated thereon. The transfer liquid has a higher viscosity than the viscosity of the liquid carrier. Liquid carrier is removed from the transfer liquid coated on the belt. Toner particles are transferred from the transfer liquid coated on the intermediate belt to the copy sheet in image configuration.

14 Claims, 1 Drawing Sheet

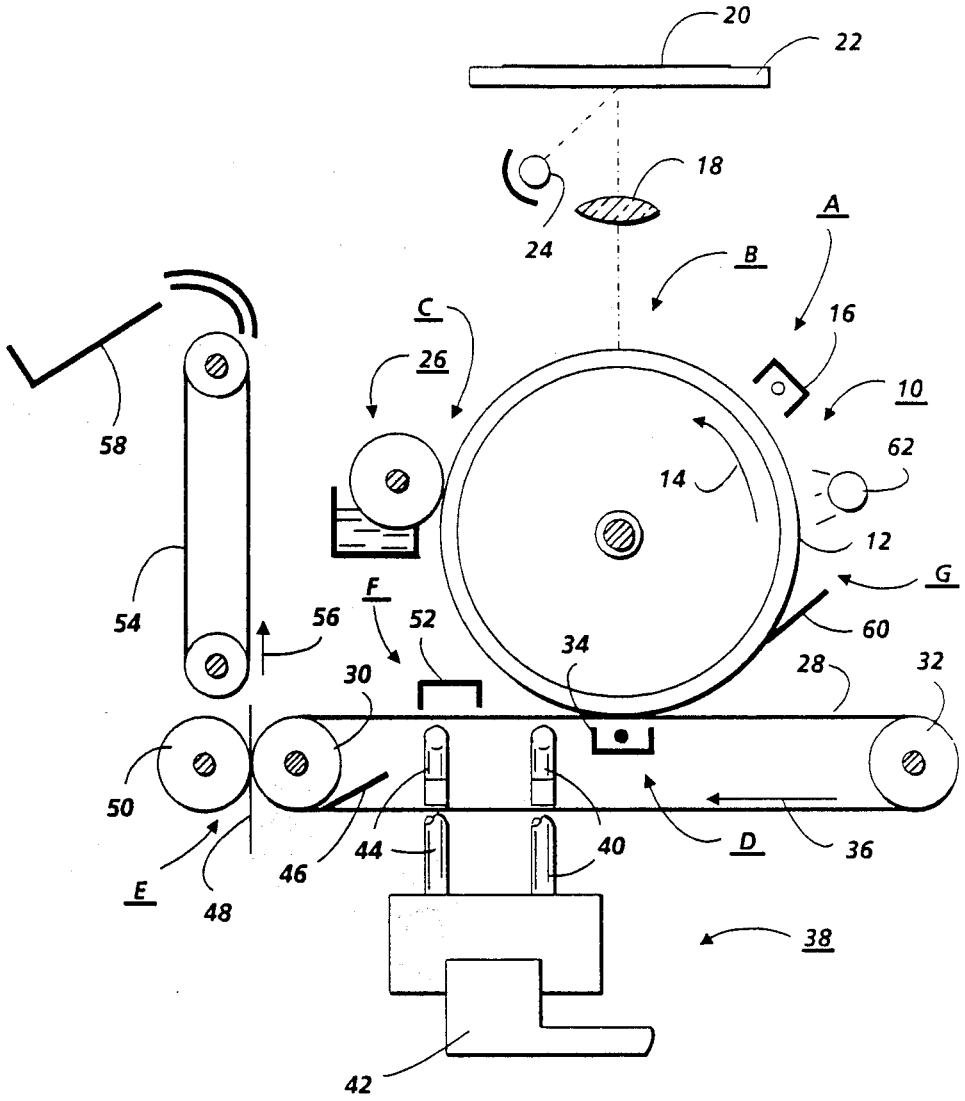
20
22
18
24
A
B
C
16
26
10
58
62
14
12
G
54
56
F
52
60
34
28
32
30
50
44
40
D
36
E
46
48
38
42

INTERMEDIATE TRANSFER APPARATUS

This invention relates generally to an electrostatographic printing machine, and more particularly concerns an apparatus for transferring a liquid image having at least a liquid carrier with toner particles from a photoconductive member to a copy sheet.

In electrophotographic printing, a charged photoconductive member is exposed to a light image of an original document. The irradiated area of the photoconductive surface is charged to record an electrostatic latent image thereon corresponding to the informational area contained within the original document. Generally, the electrostatic latent image is developed by bringing a developer mixture into contact therewith. A dry developer mixture usually comprises carrier granules having toner particles adhering triboelectrically thereto. Toner particles are attracted from the carrier granules to the latent image forming a toner powder image thereon. Alternatively, a liquid developer material may be employed. The liquid developer material includes a liquid carrier having toner particles dispersed therein. The liquid developer material is advanced into contact with the electrostatic latent image and the toner particles are deposited thereon in image configuration. After the toner particles have been deposited on the photoconductive surface, in image configuration, it is transferred to a copy sheet. Generally, when a liquid developer material is employed, the copy sheet is wet with both the toner particles and the liquid carrier. Thus, it becomes necessary to remove the liquid carrier from the copy sheet. This may be accomplished by drying the copy sheet prior to fusing the toner particles thereto or relying upon the fusing process to permanently fuse the toner particles to the copy sheet as well as vaporizing the liquid carrier adhering thereto. Clearly, it is desirable to refrain from transferring any liquid carrier to the copy sheet. Thus, it is advantageous to transfer the developed image to an intermediate web or belt and to subsequently remove the liquid carrier therefrom prior to the transfer of the toner particles to the copy sheet. The following disclosure appears to be relevant:

U.S. Pat. No. 4,610,939

Patentee: Mampaey et al.

Issued: Sept. 9, 1986

The relevant portion of the foregoing patent may be briefly summarized as follows:

Mampaey et al. discloses the transfer of an electrostatically deposited toner image from a first surface to a second surface. The transfer of the toner particles occurs within a meniscus of the surface's carrier liquid which is charged to improve the transfer of the image quality.

In accordance with one aspect of the present invention, there is provided an apparatus for transferring a liquid image having at least a liquid carrier with toner particles dispersed therein from a member to a copy sheet. The apparatus includes an intermediate member positioned to have at least a portion thereof adjacent the member in a transfer zone. A transfer liquid is coated on the intermediate member. The transfer liquid has a higher viscosity than the viscosity of the liquid carrier. Means, located in the transfer zone, attract the liquid image from the member to the transfer liquid on the intermediate member. Means are provided for removing liquid carrier from the transfer liquid on the intermediate member. Means transfer the toner particles from the transfer liquid on the intermediate member to the copy sheet in image configuration.

Pursuant to another aspect of the features of the present invention, there is provided an electrophotographic printing machine of the type having a liquid image of liquid carrier with toner particles dispersed therein formed on a photoconductive member. An intermediate member is positioned to have at least a portion thereof adjacent the photoconductive member in a transfer zone. A transfer liquid is coated on the intermediate member. The transfer liquid has a higher viscosity than the viscosity of the liquid carrier. Means, located in the transfer zone, attract the liquid image from the photoconductive member to the transfer liquid on the intermediate member. Means remove liquid carrier from the transfer liquid on the intermediate member. Means are provided to transfer the toner particles from the transfer liquid on the intermediate member to the copy sheet in image configuration.

Other aspects of the present invention will become apparent as the following description proceeds and upon reference to the drawing which depicts an electrophotographic printing machine incorporating the transfer apparatus of the present invention therein.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

In the drawing, like reference numerals have been used throughout to designate identical elements. It will become apparent from the following discussion that the apparatus of the present invention may be equally well suited for use in a wide variety of printing machines and is not necessarily limited in it's application to the particular embodiment shown herein.

Turning now to the drawing, the electrophotographic printing machine employs a photoconductive member having a drum 10 mounted rotatably within the printing machine. The photoconductive surface 12 is mounted on the exterior circumferential surface of drum 10 and entrained thereabout. A series of processing stations are positioned about drum 10 such that as drum 10 rotates in the direction of arrow 14, it passes sequentially therethrough. Drum 10 is driven at a predetermined speed relative to the other machine operating mechanisms by a drive motor. Timing detectors sense the rotation of drum 10 and communicate with the machine logic to synchronize the various operations thereof with the rotation of drum 10. In this manner, the proper sequence of events is produced at the respective processing stations.

Drum 10 initially rotates the photoconductive surface 12 through charging station A. At charging station A, a corona generating device, indicated generally by the reference numeral 16 sprays ions onto photoconductive surface 12 producing a relatively high, substantially uniform charge thereon.

Next, the charged photoconductive surface is rotated on drum 10 to exposure station B. At exposure station B, a light image of an original document 20 is projected onto the charged portion of the photoconductive surface 12. Exposure station B includes a moving lens system, generally designated by the reference numeral 18. Original document 20 is positioned face down upon a generally planar, substantially transparent platen 22. Lamps 24 are adapted to move in a timed relationship with lens 18 to scan successive incremental areas of original document 20. In this manner, a flowing light image of original document 20 is projected onto the charged portion of photoconductive surface 12. This selectively dissipates the charge on photoconductive surface 12 to record an electrostatic latent image thereon corresponding to the informational areas in original document 20. While a light lens system has heretofore been described, one skilled in the art will appreciate that other techniques, such as a modulated laser beam may be employed to selectively discharge the charged portion of the photoconductive surface to record the electrostatic latent image thereon.

After exposure, drum 10 rotates the electrostatic latent image recorded on photoconductive surface 12 to development station C. Development station C includes a developer unit, generally indicated by the reference numeral 26. Developer unit 26 includes a roller adapted to advance the liquid developer material into contact with the elctrostatic latent image recorded on photoconductive surface 12. By way of example, the liquid developer material comprises an insulating carrier material made from an aliphatic hydrocarbon, largely decane, which is manufactured by the Exxon Corporation, under the trademark Isopar having toner particles dispersed therein. Preferably, the toner particles are made predominantly from a pigmented material such as a suitable resin. A suitable liquid developer material is described in U.S. Pat. No. 4,582,774 issued Landa in 1986, the relevant portions thereof being hereby incorporated into the present application. The developed electrostatic latent image is transported on drum 10 to transfer station D.

At transfer station D, the developed liquid image is electrostatically transferred to an intermediate member or a belt indicated generally by the reference numeral 28. Belt 28 is entrained about spaced rollers 30 and 32, respectively. Roller 30 is heated. A layer of transfer liquid is coated on belt 28. Belt 28 is made from a porous material. Preferably, the transfer fluid is an oil made from an aliphatic hydrocarbon, largely a saturated, unbranched alkane, having a high boiling point and a viscosity of about 9 centipoise. Other materials, such as silicone oils and paraffin oils may also be used. However, it is necessary that the viscosity of the transfer liquid be greater than the viscosity of the liquid carrier of the developer material, and that the transfer liquid be an immiscible fluid. Belt 28 moves in the direction of arrow 36. A corona generating device, indicated generally by the reference numeral 34, sprays ions onto the back side of belt 28 to attract the liquid developed image to the transfer liquid coated thereon. As belt 28 advances in the direction of arrow 36, the liquid image transferred to the transfer liquid coated thereon advances to a liquid management system, indicated generally by the reference numeral 38. Liquid management system 38 employs a vacuum pump to apply suction to the back surface of belt 28 through duct 40. The open end of duct 40 is positioned adjacent the back surface of belt 28, i.e. the surface devoid of the liquid developer material. Duct 40 is connected to the vacuum pump of liquid management system 38. The pore size of belt 28 is selected to permit the ready passage of the liquid carrier therethrough. However, the viscosity of the transfer liquid, in combination with the selected pore size of the belt, does not readily enable the transfer liquid to pass through the pores in belt 28. The low pressure generated by duct 40 causes the liquid carrier to be drawn through the transfer liquid and the pores of belt 28 into duct 40 to liquid management system 40. Liquid management system 38 has a cold trap 42 for condensing any vaporized liquid carrier. The liquid carrier is pumped from liquid management system 38 to a collection container for subsequent reclaimation for reuse or discarding. Liquid management system 38 also furnishes a supply of hot transfer liquid onto the back surface of belt 28. Duct 44 is coupled to a pump of liquid management system 38. This pump generates a flow of hot transfer liquid though duct 44 onto the surface of belt 28. Metering blade 46 has the free edge thereof positioned closely adjacent the back surface of belt 28 to meter the quantity of heated transfer liquid disposed thereon. The hot transfer liquid passes through the pores of belt 28 onto the front surface thereof to aid in transfer of the toner image from belt 28 to the copy sheet.

With continued reference to the drawing, the toner image and transfer liquid are advanced on belt 28, in the direction of arrow 36, to transfer and fusing station E. At transfer and fusing station E, copy sheet 48 is advanced, in synchronism, with the toner image on belt 28. Transfer station E includes a pressure roller 50 positioned in engagement with belt 28 as it wraps about the heated roller 30. This defines a nip through which the copy sheet passes in synchronism with the toner image and transfer liquid on belt 28. The toner image and, at least some of the transfer liquid are transferred to copy sheet 48. The hot, high viscosity transfer liquid transferred to the copy sheet is absorbed into the paper. The remainder of the transfer liquid continues to move with belt 28 to cleaning station F. The toner image transferred to copy sheet 48 is simultaneously fused thereto. The copy sheet with the toner image fused thereto advances on conveyor 54, in the direction of arrow 56, to catch tray 58 for subsequent removal from the printing machine by the operator.

Cleaning station F includes a cleaning apparatus 52 adapted to remove the residual transfer liquid adhering to belt 28 and supplying fresh transfer liquid thereon. Cleaning apparatus 52 includes a brush and vacuum system for removing the residual transfer liquid from belt 28. Liquid management system 38 is coupled to cleaning apparatus 52 to furnish heated transfer liquid through suitable ducts thereto for dispensing onto the surface of belt 28 prior to the transfer of the developed liquid thereto from photoconductive surface 12 of drum 10.

Invariably, some residual liquid carrier and toner particles remain adhering to photoconductive surface 12 of drum 10 after the transfer thereof to belt 28. These residual particles and liquid carrier are removed from photoconductive surface 12 at cleaning station G. Cleaning station G includes a flexible, resilient blade 60. This blade has the free end portion thereof in contact with photoconductive surface 12 to remove any material adhering thereto. Thereafter, lamp 62 is energized to discharge any residual charge on photoconductive surface 12 preparatory for the next successive imaging cycle.

While the printing machine hereinbefore described is adapted to transfer a single image to the transfer liquid coated on the intermediate belt and therefrom to the copy sheet, one skilled in the art will appreciate that multiple images may also be transferred, as in the case of a multicolor printing machine.

In recapitulation, it is clear that a porous intermediate belt having a transfer liquid coated thereon receives a developed liquid image from a photoconductive member. The liquid carrier is drawn through the transfer liquid and belt so as to be removed therefrom prior to the transfer of the toner image to the copy sheet. The transfer liquid remaining on the intermediate belt assists in the transfer of the toner image to the copy sheet. A portion of the transfer liquid is absorbed into the copy sheet with the remainder being cleaned from the belt before the next imaging cycle is initiated.

It is, therefore, apparent that there has been provided, in accordance with the present invention, an apparatus for transferring a liquid image to an intermediate belt and transferring the resultant toner particles to a copy sheet in image configuration. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

We claim:

1. An apparatus for transferring a liquid image having at least a liquid carrier with toner particles dispersed therein from a member to a copy sheet, including:

an intermediate member positioned to have at least a portion thereof adjacent the member in a transfer zone;

a transfer liquid coated on said intermediate member, said transfer liquid having a higher viscosity than the viscosity of the liquid carrier;

means, located in the transfer zone, for attracting the liquid image from the member to the transfer liquid on said intermediate member;

means for removing liquid carrier from the transfer liquid on said intermediate member; and means for transferring the toner particles from the transfer liquid on said intermediate member to the copy sheet in image configuration.

2. An apparatus according to claim 1, wherein said intermediate member is a porous belt.

3. An apparatus according to claim 2, wherein said removing means includes means for drawing the liquid carrier though the transfer fluid and said belt.

4. An apparatus according to claim 3, wherein said attracting means includes a corona generator positioned in the transfer zone adjacent said belt on the side thereof opposed from said member.

5. An apparatus according to claim 4, wherein said transferring means includes a transfer roll in engagement with said belt to define a nip through which the copy sheet passes to receive the toner particles in image configuration and a portion of the transfer liquid from said belt.

6. An apparatus according to claim 5, wherein said intermediate member includes at least a pair of spaced rollers, one of said pair of spaced rollers being opposed from said transfer roll.

7. An apparatus according to claim 6, wherein said one of said pair of spaced rollers is heated.

8. An electrophotographic printing machine of the type having a liquid image of liquid carrier with toner particles dispersed therein formed on a photoconductive member, including:

an intermediate member positioned to have at least a portion thereof adjacent the photoconductive member in a transfer zone;

a transfer liquid coated on said intermediate member, said transfer liquid having a higher viscosity than the viscosity of the liquid carrier;

means, located in the transfer zone, for attracting the liquid image from the photoconductive member to the transfer liquid on said intermediate member;

means for removing liquid carrier from the transfer liquid on said intermediate member; and means for transferring the toner particles from the transfer liquid on said intermediate member to the copy sheet in image configuration.

9. A printing machine according to claim 8, wherein said intermediate member is a porous belt.

10. A printing machine according to claim 9, wherein said removing means includes means for drawing the liquid carrier though the transfer fluid and said belt.

11. A printing machine according to claim 10, wherein said attracting means includes a corona generator positioned in the transfer zone adjacent said belt on the side thereof opposed from the photoconductive member.

12. A printing machine according to claim 11, wherein said transferring means includes a transfer roll in engagement with said belt to define a nip through which the copy sheet passes to receive the toner particles in image configuration and a portion of the transfer liquid from said belt.

13. A printing machine according to claim 12, wherein said intermediate member includes at least a pair of spaced rollers, one of said pair of spaced rollers being opposed from said transfer roll.

14. A printing machine according to claim 13, wherein said one of said pair of spaced rollers is heated.

* * * * *